US008480442B2

(12) United States Patent
Pini

(10) Patent No.: US 8,480,442 B2
(45) Date of Patent: Jul. 9, 2013

(54) CLAMP FOR ELECTRICAL CONNECTIONS

(76) Inventor: Belisario Pini, Florence (IT)

( * ) Notice: Subject to any disclaimer, the term of this patent is extended or adjusted under 35 U.S.C. 154(b) by 2 days.

(21) Appl. No.: 13/382,300

(22) PCT Filed: Jun. 30, 2010

(86) PCT No.: PCT/IT2010/000288
§ 371 (c)(1),
(2), (4) Date: Jan. 5, 2012

(87) PCT Pub. No.: WO2011/004412
PCT Pub. Date: Jan. 13, 2011

(65) Prior Publication Data

US 2012/0115373 A1 May 10, 2012

(30) Foreign Application Priority Data

Jul. 8, 2009 (IT) ..... FI2009A0152

(51) Int. Cl.
*H01R 4/36* (2006.01)

(52) U.S. Cl.
USPC ..... 439/814

(58) Field of Classification Search
USPC ..... 439/814, 810, 813, 100
See application file for complete search history.

(56) References Cited

U.S. PATENT DOCUMENTS

| | | | | |
|---|---|---|---|---|
| 3,133,779 | A * | 5/1964 | Stanback | 439/798 |
| 3,191,139 | A * | 6/1965 | Schiffmann | 439/412 |
| 3,988,052 | A * | 10/1976 | Mooney et al. | 439/804 |
| 4,925,395 | A * | 5/1990 | Franks, Jr. | 439/100 |
| 7,044,776 | B2 * | 5/2006 | King et al. | 439/521 |
| 7,621,763 | B2 * | 11/2009 | Clark et al. | 439/100 |
| 2012/0115373 | A1 * | 5/2012 | Pini | 439/814 |

FOREIGN PATENT DOCUMENTS

| | | |
|---|---|---|
| DE | 25 38 199 A1 | 3/1977 |
| FR | 2 114 225 A5 | 6/1972 |
| GB | 142 734 A | 5/1920 |
| GB | 2 263 824 A | 8/1993 |

* cited by examiner

*Primary Examiner* — Ross Gushi
(74) *Attorney, Agent, or Firm* — McGlew and Tuttle, P.C.

(57) ABSTRACT

Clamp for electrical connections comprising a metal body (1) in which more seats are provided for the electrical connection with a cable or carrier wire (2) and for the electrical connection of one or more cables or derivation wires (3) and means for locking said cables or carrier wires (2, 3) to said metal body (1). The metal body (1) exhibits a channel (10) which is open laterally thus forming a mouth where a bare portion (2N) of the carrier wire (2), which can pass through the same open channel (10) without being interrupted. The channel (10) has a circle arc cross section, with an angular extension greater than 180°, and the ends of said circle arc are joined to two rectilinear edges (11) which frontally delimit the channel (10).

5 Claims, 3 Drawing Sheets

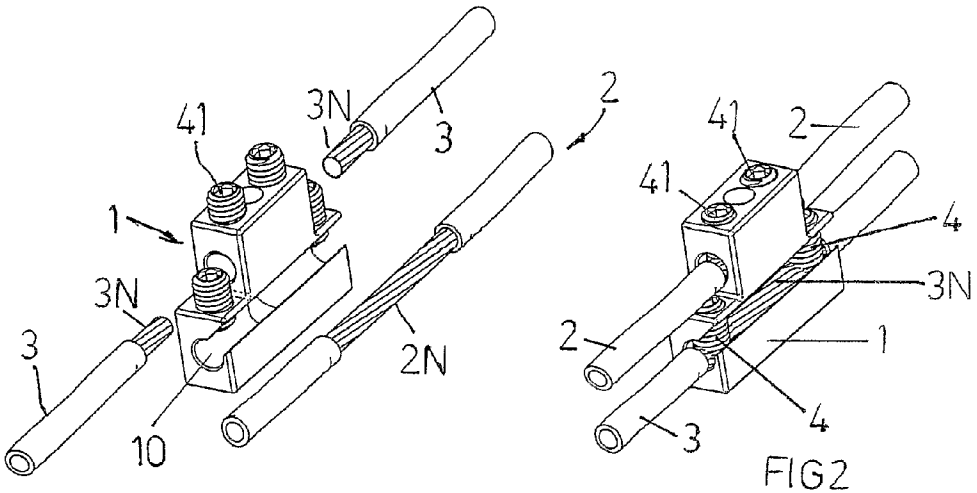
FIG.1
FIG.2
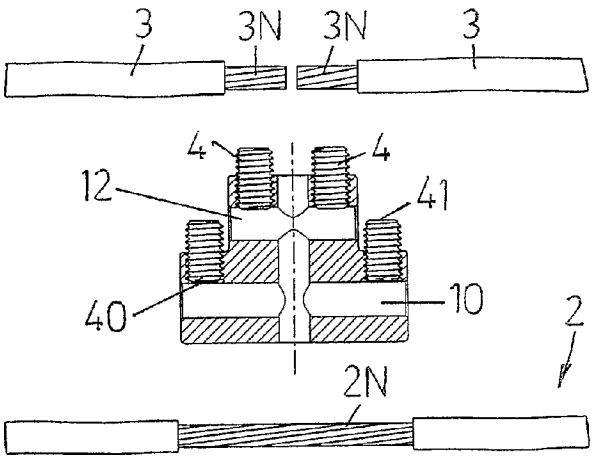
FIG.3

CLAMP FOR ELECTRICAL CONNECTIONS

The present invention relates to a clamp for electrical connections.

It is well-known that, in general, a clamp for electrical connections comprises a metal body provided with suitable seats for the ends of the carrier wires to be connected and for screw locking means which allow the locking of the said terminals in the said seats.

The said clamps have some drawbacks, among which the fact that, when they are used to realize cascade connections, whenever a carrier wire is interrupted due to a malfunctioning clamp or because one end of the carrier wire detaches from the clamp, said interruption affects the whole plant downstream thereof and compromises its correct functioning.

Document GB 2263824 describes a clamp for electrical connections according to the preamble of claim 1. In said clamp, the channel for the carrier wire has a "V" shaped cross section, so the strands of the wire can easily be subjected to breaking when they are locked by the locking screws. Moreover, if the carrier wire is a circular section full core carrier wire, that is to say it is made of twisted strands, the contact between the carrier wire and the bottom of the channel is not sufficient to guarantee an adequate level of electrical conduction.

Document U.S. Pat. No. 3,191,139 describes a closed channel clamp for electrical connections with the bottom of the channel provided with sharp edges for cutting the insulating sheath which surrounds the electrical carrier wire inserted in it. Due to the shape of the said sharp edges, which project towards the internal part of the channel, also this clamp has the above mentioned drawbacks.

The main aim of the present invention is to eliminate or, at least, to remarkably reduce said drawbacks.

These results have been achieved, according to the present invention, by adopting the idea of building a device having the features described in claim 1. Further features of the present invention are the subject of the dependent claims.

Thanks to the present invention, it is possible to ensure the continuity of any electrical carrier line also in case of a malfunctioning derivation clamp, with a structurally simple device whose use is easy and immediate. Moreover, a device according to the present invention is easy to build, economical and reliable. Besides this, there is the fact that the device subject of the present invention can be provided with locking means for the wires apt to guarantee the integrity thereof.

Every technician who works in this field will better understand these advantages and further advantages and features of the present invention thanks to the following description and to the enclosed drawings which are an exemplification and should not be considered in a limitative sense, wherein:

FIG. 1 shows a schematic perspective view of a clamp according to the present invention which is ready for use;

FIG. 2 shows a schematic perspective view of the clamp of FIG. 1 in its operative position;

FIG. 3 shows a schematic longitudinal section view of the clamp of FIG. 1;

Figure 6:
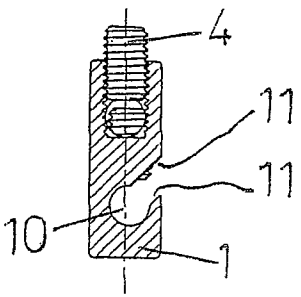
FIG. 6 shows a schematic cross section view of the clamp of FIG. 1.
Figure 5:
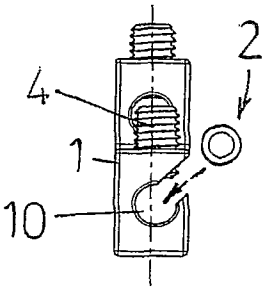
FIG. 5 shows a schematic lateral view of the clamp of FIG. 1.
Figure 7:
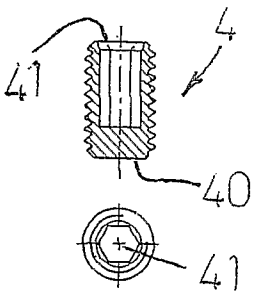
FIG. 7 shows a schematic diametral section view of a locking screw of the electric wires.
Figure 4:
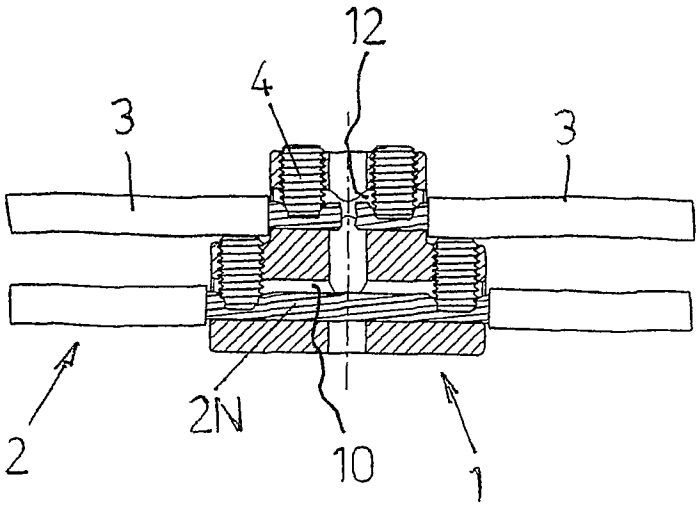
FIG. 4 shows a schematic longitudinal section view of the clamp of FIG. 2.

Reduced to its essential structure and with reference to the enclosed drawings, a clamp for electrical connections according to the present invention comprises:

- a metal body (1) in which more seats are provided for its electrical connection with an electrical carrier wire (2) and for the electrical connection of one or more derivation cables or wires (3);
- means for locking said cables or wires (2, 3) to said metal body (1).

According to the embodiment shown in the enclosed drawings, said body (1) exhibits a channel (10) open laterally where it can be inserted, as further described, a corresponding bare portion (2N) of a carrier wire or cable. (2).

In practice, the said channel (10) forms a mouth, open towards the external part of the body (1), for the portion (2N) of the carrier wire (2).

According to the embodiment shown in the figures of the enclosed drawings, said channel (10) is concave in cross section and is delimited, on its outer side (the side turned towards the external part of the body 1), by two rectilinear edges (11) converging towards said concavity to facilitate the positioning of the portion (2N) of the carrier wire (2) in the same channel (10).

As shown in the enclosed drawings, said channel (10) has a circle arc cross section, with an angular extension greater than 180°. The ends of said circle arc are joined with continuity to said rectilinear edges. (11).

The circular, concave shape of the channel (10) ensures the best contact between the metal of the carrier wire (2) and the metal of the body (1) also when the core of the wire (2) is a full section core, that is to say not made of strands. Moreover, if the core of the carrier wire (2) is made of twisted strands, the locking of the carrier wire—as described in the following—will not cause the strands to break.

Preferably, said rectilinear edges (11) are parallel to each other.

Upperly to said channel (10) the metal body (1) exhibits an appendix with a closed longitudinal channel (12) into which the bare ends (3N) of said carrier wires (3) are introduced.

In the embodiment shown in the figure, the metal body (1) has an upside down "T" shape, with the open channel (10) provided by the horizontal part of the "T" and with the closed channel (12) which is positioned above and provided by the vertical part of the same "T". Said shape of the body (1) offers the possibility of disposing more easily a plurality of derivation wires (3) oriented parallel to the carrier wire and to use more easily an insulating box, such as the insulating box described in the following and shown in the FIGS. 8 and 9.

More particularly, the locking means of the carrier wires or cables (2, 3) are formed by pistons with a flat lower base—passing through corresponding holes provided by the body (1)—which drag on the bare portions (2N, 3N) some carrier wires (2, 3) and, as their lower base (destined to the contact with the copper of the carrier wires) is flat, the copper of the portions (2N, 3N) of the carrier wires (2, 3) is crushed and locked in the channels (10, 12) without being cut as happens when conventional screws, which cause the strands to be cut, are used.

For example, as shown in the figures of the enclosed drawings, said locking means are formed by screws (4) with a flat base (40, that is to say orthogonal to the longitudinal axis of the screw (4), and oriented perpendicular to the channels (10)

and (12). The screws (4) pass through corresponding holes with female thread oriented perpendicularly to the channels (10) (12) of the body (1).

In the embodiment, there are four screws (4)—two to lock the portion (2N) of the wire (2) and one for each of the portions (3N) of the carrier wires (3)—which exhibit a head (41) with a hexagonal cavity.

The use of a clamp according to the embodiment described below is as follows:

The bare portion (2N) of the carrier wire (2) is inserted into the open channel (10) of the body (1) by simply passing it through the open side of the channel. Thus, the carrier wire (2) is locked by using corresponding screw pistons (4). A this point, the points of the portions (3N) of the derivation wires (3) are inserted, from opposite sides, into the channel (12), and then the screw pistons (4) are used to lock said portions (3N) in the channel (12).

Since the channel (10) is open on one side of the body (1), it is possible to introduce the portion (2N) of the carrier wire (2) into it, without interrupting the continuity of the latter so as to overcome the above mentioned drawbacks. In other words, the portion (2N) of the carrier wire (2) extends without any interruption along the channel (10) and the carrier wire (2) and passes through the channel (10) without being interrupted.

Moreover, by using the locking pistons (4) with a flat lower base instead of conventional locking screws, it is possible to preserve the integrity of the carrier wires (2, 3).

Figure 9:
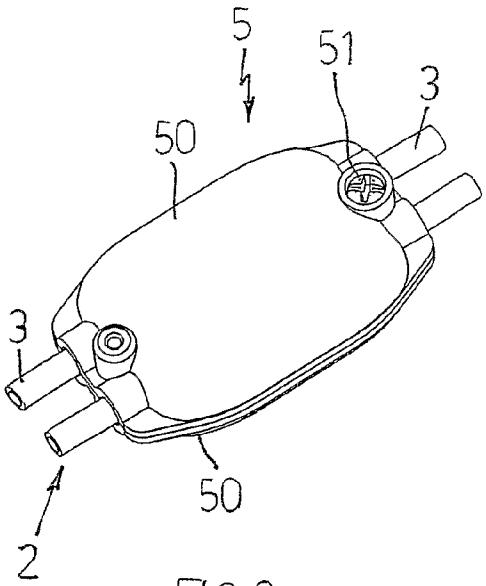
FIGS. 8 and 9 show the positioning of a clamp according to the invention in a box containing an insulating gel and, respectively, the closed box with the clamp inside it.
Figure 8:
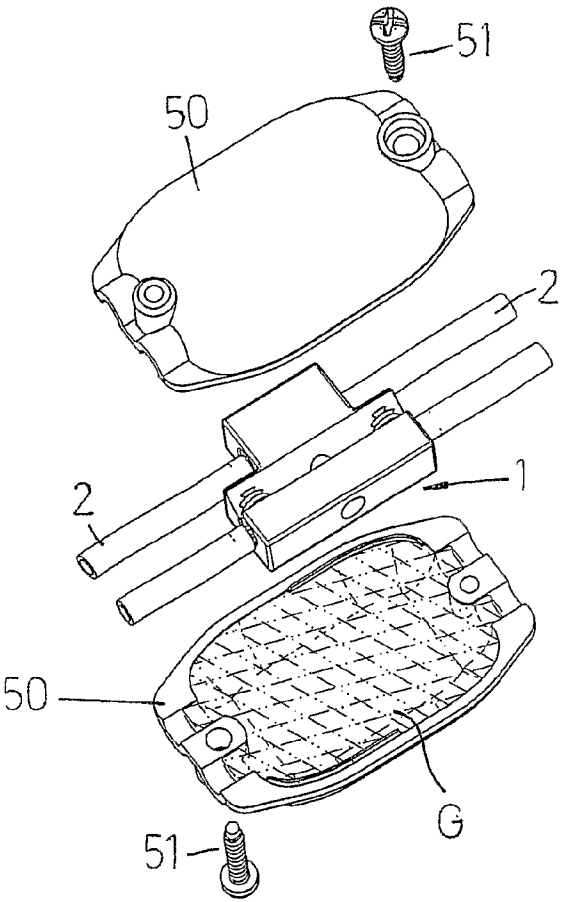

As shown in FIG. 8 and in FIG. 9, once the connections have been executed, the clamp (1) with the cables (2,3) associated with it can be inserted into a cap (5) formed by two half shells (50) containing a known insulating gel (G) and kept together by two corresponding connecting screws (51).

In practice, the construction details may vary in any equivalent way as regards the single described and illustrated elements, without nevertheless departing from the scope of the adopted solution idea and thereby remaining within the limits of the protection granted to the present patent.

The invention claimed is:

1. A clamp for electrical connections comprising:

a metal body in which seats are provided for electrical connection with a cable or carrier wire and for the electrical connection of one or more cables or derivation wires and means for locking said cables or carrier wires to said metal body, the metal body comprising a channel which is open laterally to form a mouth where a bare portion of the carrier wire can pass through the open channel without being interrupted, said channel having a concave cross section and is delimited, on an outer side thereof, by two rectilinear edges converging towards said concavity, said channel having a circle arc cross section, with an angular extension greater than 180°, and the ends of said circle being joined with continuity to said rectilinear edges, wherein, at the top of said open channel, said metal body comprises an appendix with a closed longitudinal channel in which bare ends of said derivation wires or cables can be inserted, said metal body being "T"-shaped, said open channel being within a horizontal part of the "T"-shaped metal body, said closed channel being within a vertical part of the "T"-shaped metal body, and said closed channel being above said open channel.

2. A clamp electrical connections according to claim 1, wherein said edges are parallel to each other.

3. A clamp for electrical connections according to claim 1, wherein said means for locking said cables or wires are pistons with a flat lower base.

4. A clamp for electrical connections according to claim 3, wherein said locking means comprises screws with a flat lower base, perpendicular to a longitudinal axis of the screws and oriented perpendicular to at least the channel of the metal body.

5. A clamp for electrical connections according to claim 1, wherein said derivation wires are parallel to the carrier wire.

* * * * *